US010656666B2

(12) United States Patent
Nakajima

(10) Patent No.: US 10,656,666 B2
(45) Date of Patent: May 19, 2020

(54) BIAS OUTPUT APPARATUS INCLUDING A PLURALITY OF VOLTAGE OUTPUT CIRCUITS, AND IMAGE FORMING APPARATUS

(71) Applicant: CANON KABUSHIKI KAISHA, Tokyo (JP)

(72) Inventor: Hirohisa Nakajima, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/505,218

(22) Filed: Jul. 8, 2019

(65) Prior Publication Data

US 2020/0026320 A1 Jan. 23, 2020

(30) Foreign Application Priority Data

Jul. 18, 2018 (JP) ..... 2018-135223

(51) Int. Cl.

*G05F 3/20* (2006.01)
*G03G 15/00* (2006.01)
*G05F 3/30* (2006.01)

(52) U.S. Cl.

CPC ..... *G05F 3/205* (2013.01); *G03G 15/80* (2013.01); *G05F 3/30* (2013.01)

(58) Field of Classification Search

None

See application file for complete search history.

(56) References Cited

U.S. PATENT DOCUMENTS 7,030,682 B2 * 4/2006 Tobita ..... H02M 3/07 327/536
9,379,618 B2 * 6/2016 Freeman ..... H02M 1/10
9,507,310 B2 * 11/2016 Nakajima ..... G03G 15/80
2011/0292259 A1 * 12/2011 Namba ..... H02M 1/36 348/294
2013/0170850 A1 * 7/2013 Maruyama ..... G03G 15/5004 399/75
2015/0177773 A1 * 6/2015 Ben Artsi ..... G05F 1/613 323/299
2017/0255152 A1 * 9/2017 Okamura ..... G03G 15/6529

FOREIGN PATENT DOCUMENTS

JP H08-202218 8/1996

* cited by examiner

*Primary Examiner* — Lincoln D Donovan
*Assistant Examiner* — Khareem E Almo
(74) *Attorney, Agent, or Firm* — Venable LLP

(57) ABSTRACT

A bias output apparatus includes: a plurality of voltage output circuits, each configured to output a bias voltage to be supplied to a load and a determination voltage generated based on the bias voltage; a determination circuit configured to output a binary determination signal based on the determination voltage output by each of the plurality of voltage output circuits; and a controller configured to control the plurality of voltage output circuits and determine whether or not the plurality of voltage output circuits are operating normally based on the determination signal output by the determination circuit. The controller is further configured to determine that the plurality of voltage output circuits are operating normally if an output pattern of the determination signal is a predetermined first pattern while the controller is controlling the plurality of voltage output circuits to output bias voltages in order.

13 Claims, 8 Drawing Sheets

FIG. 5

| | DEVELOPING BIAS Y | DEVELOPING BIAS M | DEVELOPING BIAS C | DEVELOPING BIAS K | COMPARATOR IC | | | |
|---|---|---|---|---|---|---|---|---|
| | | | | | 701 | 702 | 703 | 704 |
| #1 | – | – | – | – | H | H | H | H |
| #2 | OUTPUT | – | – | – | L | H | H | H |
| #3 | OUTPUT | OUTPUT | – | – | H | L | H | H |
| #4 | OUTPUT | OUTPUT | OUTPUT | – | L | H | L | H |
| #5 | OUTPUT | OUTPUT | OUTPUT | OUTPUT | H | L | H | L |
| #6 | – | OUTPUT | OUTPUT | OUTPUT | H | L | H | L |
| #7 | – | – | OUTPUT | OUTPUT | H | H | H | L |
| #8 | – | – | – | OUTPUT | H | H | H | L |
| #9 | – | – | – | – | H | H | H | H |

FIG. 8

| | DEVELOPING BIAS Y | DEVELOPING BIAS M | DEVELOPING BIAS C | DEVELOPING BIAS K | COMPARATOR IC | | | | EXOR IC | | |
|---|---|---|---|---|---|---|---|---|---|---|---|
| | | | | | 801 | 802 | 803 | 804 | 805 | 806 | 807 |
| #1 | – | – | – | – | H | H | H | H | L | L | L |
| #2 | OUTPUT | – | – | – | L | H | H | H | H | L | H |
| #3 | OUTPUT | OUTPUT | – | – | L | L | H | H | L | L | L |
| #4 | OUTPUT | OUTPUT | OUTPUT | – | L | L | L | H | L | H | H |
| #5 | OUTPUT | OUTPUT | OUTPUT | OUTPUT | L | L | L | L | L | L | L |
| #6 | – | OUTPUT | OUTPUT | OUTPUT | H | L | L | L | H | L | H |
| #7 | – | – | OUTPUT | OUTPUT | H | H | L | L | L | L | L |
| #8 | – | – | – | OUTPUT | H | H | H | L | L | H | H |
| #9 | – | – | – | – | H | H | H | H | L | L | L |

BIAS OUTPUT APPARATUS INCLUDING A PLURALITY OF VOLTAGE OUTPUT CIRCUITS, AND IMAGE FORMING APPARATUS

BACKGROUND OF THE INVENTION

Field of the Invention

The present disclosure relates to a bias output apparatus and an image forming apparatus including the bias output apparatus.

Description of the Related Art

Electrophotographic image forming apparatuses use various high-voltage biases during image forming processes. An image forming apparatus therefore includes a voltage output circuit that generates and outputs a high-voltage bias. Japanese Patent Laid-Open No. 8-202218 discloses a sensing circuit that determines whether or not a voltage output circuit has malfunctioned by comparing a voltage generated on the basis of a high-voltage bias output by the voltage output circuit with a predetermined value. The sensing circuit outputs a binary signal, indicating whether or not a malfunction has occurred, to a control circuit.

According to the configuration disclosed in Japanese Patent Laid-Open No. 8-202218, in a case where malfunctions in a plurality of voltage output circuits are to be detected, it is necessary to output the same number of binary signals as there are voltage output circuits to the control circuit. For example, an image forming apparatus that forms images using four colors generates four developing bias voltages using four voltage output circuits for developing. Accordingly, in a case where malfunctions are to be detected for the four voltage output circuits for developing, it is necessary to output binary signals indicating whether or not a malfunction has occurred to the control circuit for each of the voltage output circuits, which increases the number of signal lines for communicating the occurrence of malfunctions.

SUMMARY OF THE INVENTION

According to an aspect of the present invention, a bias output apparatus includes: a plurality of voltage output circuits, each configured to output a bias voltage to be supplied to a load and a determination voltage generated based on the bias voltage; a determination circuit configured to output a binary determination signal based on the determination voltage output by each of the plurality of voltage output circuits; and a controller configured to control the plurality of voltage output circuits and determine whether or not the plurality of voltage output circuits are operating normally based on the determination signal output by the determination circuit. The controller is further configured to determine that the plurality of voltage output circuits are operating normally if an output pattern of the determination signal is a predetermined first pattern while the controller is controlling the plurality of voltage output circuits to output bias voltages in order.

Further features of the present disclosure will become apparent from the following description of exemplary embodiments with reference to the attached drawings.

BRIEF DESCRIPTION OF THE DRAWINGS

FIG. 5 is a diagram illustrating a malfunction detection process according to an embodiment.

FIG. 8 is a diagram illustrating a malfunction detection process according to an embodiment.

DESCRIPTION OF THE EMBODIMENTS

Hereinafter, exemplary embodiments of the present disclosure will be described with reference to the drawings. Note that the following embodiments are to be taken as examples only, and the present disclosure is not intended to be limited by the embodiments. Note also that constituent elements not necessary for the descriptions of the embodiments have been omitted from the drawings.

First Embodiment

Figure 1:
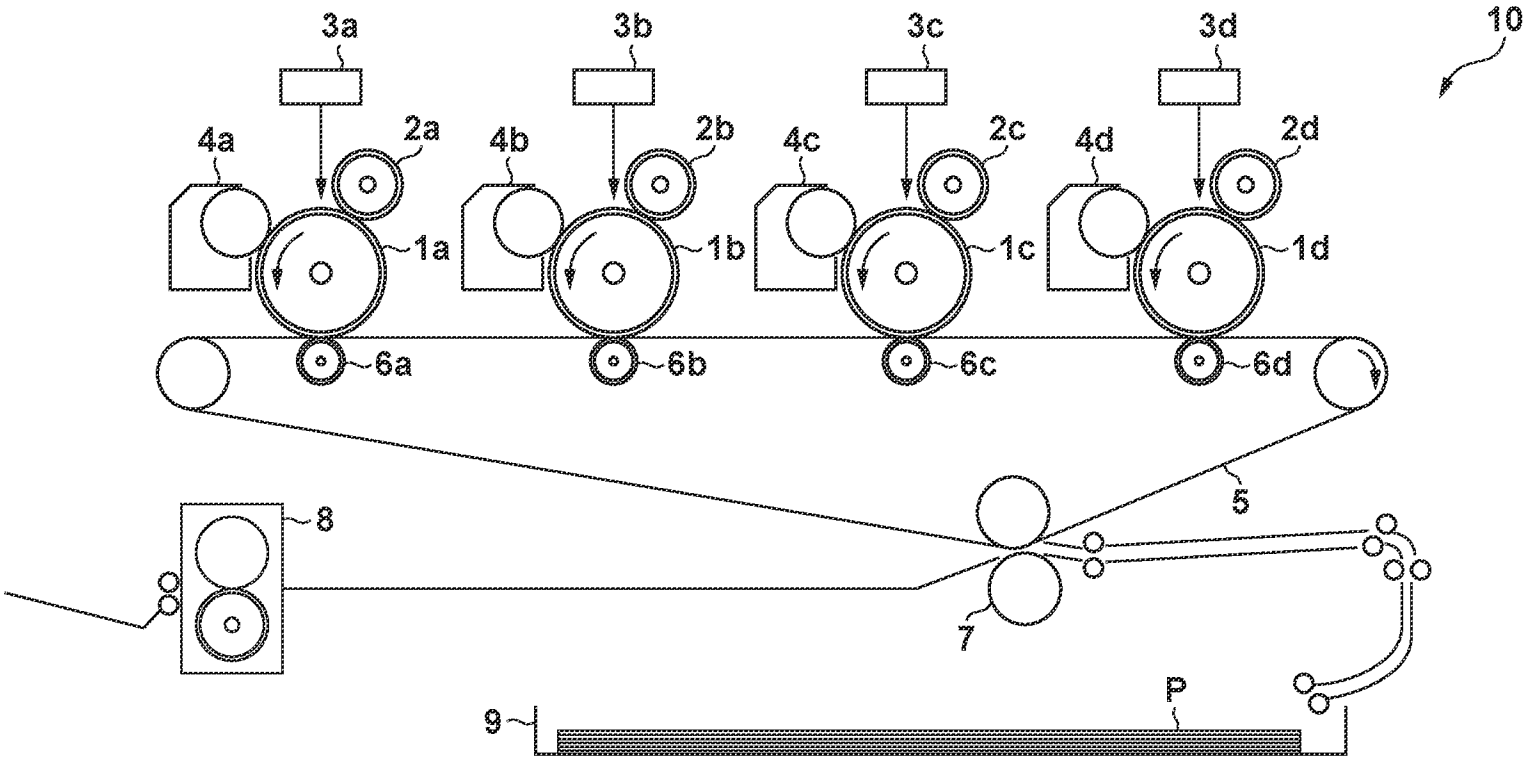
FIG. 1 is a schematic diagram illustrating an image forming apparatus according to an embodiment.

FIG. 1 is a schematic diagram illustrating an image forming apparatus 10 according to the present embodiment. The image forming apparatus 10 includes image forming units for each of yellow (Y), magenta (M), cyan (C), and black (K) colors, which form toner images of those respective colors and transfer the toner images onto an intermediate transfer belt 5. Specifically, members for which an "a" is appended to the reference signs in FIG. 1 constitute the yellow image forming unit, members for which a "b" is appended to the reference signs constitute the magenta image forming unit, members for which a "c" is appended to the reference signs constitute the cyan image forming unit, and members for which a "d" is appended to the reference signs constitute the black image forming unit. Aside from the color of the toner used, the configurations of the image forming units are the same, and thus the formation of the yellow toner image by the yellow image forming unit, and the transfer of that toner image onto the intermediate transfer belt 5, will be described below as a representative example. During image formation, a photosensitive member 1*a* is rotationally driven in the counterclockwise direction in FIG. 1. A charging roller 2*a* charges the surface of the photosensitive member 1*a* to a uniform potential by outputting a charging bias voltage. Note that "bias voltage" will be called simply "bias" hereinafter. A laser scanner 3*a* exposes the photosensitive member 1*a* to form an electrostatic latent image on the photosensitive member 1*a*. A developer 4*a* develops the electrostatic latent image on the photosensitive member 1*a* using toner to form the yellow toner image on the surface of the photosensitive member 1*a* by outputting a developing bias. A primary transfer roller 6*a* transfers the toner image on the photosensitive member 1*a* to the intermediate transfer belt 5, which is rotationally driven in the clockwise direction in FIG. 1, by outputting a primary transfer bias. Note that a full-color toner image can be formed on the intermediate transfer belt 5 by transferring the toner images on the photosensitive members 1*a* to 1*d* onto the intermediate transfer belt 5 so as to be superimposed over one another. By outputting a secondary transfer bias, a secondary transfer roller 7 transfers the toner image on the intermediate transfer belt 5 onto a recording material or sheet P conveyed from a paper cassette 9. The recording material P onto which the toner image has been transferred is conveyed to a fixer 8. The fixer 8 fixes the toner image to the recording material P by heating and pressing the recording material P. After the toner image has been fixed, the recording material P is discharged to the outside of the image forming apparatus 10.

Figure 2:
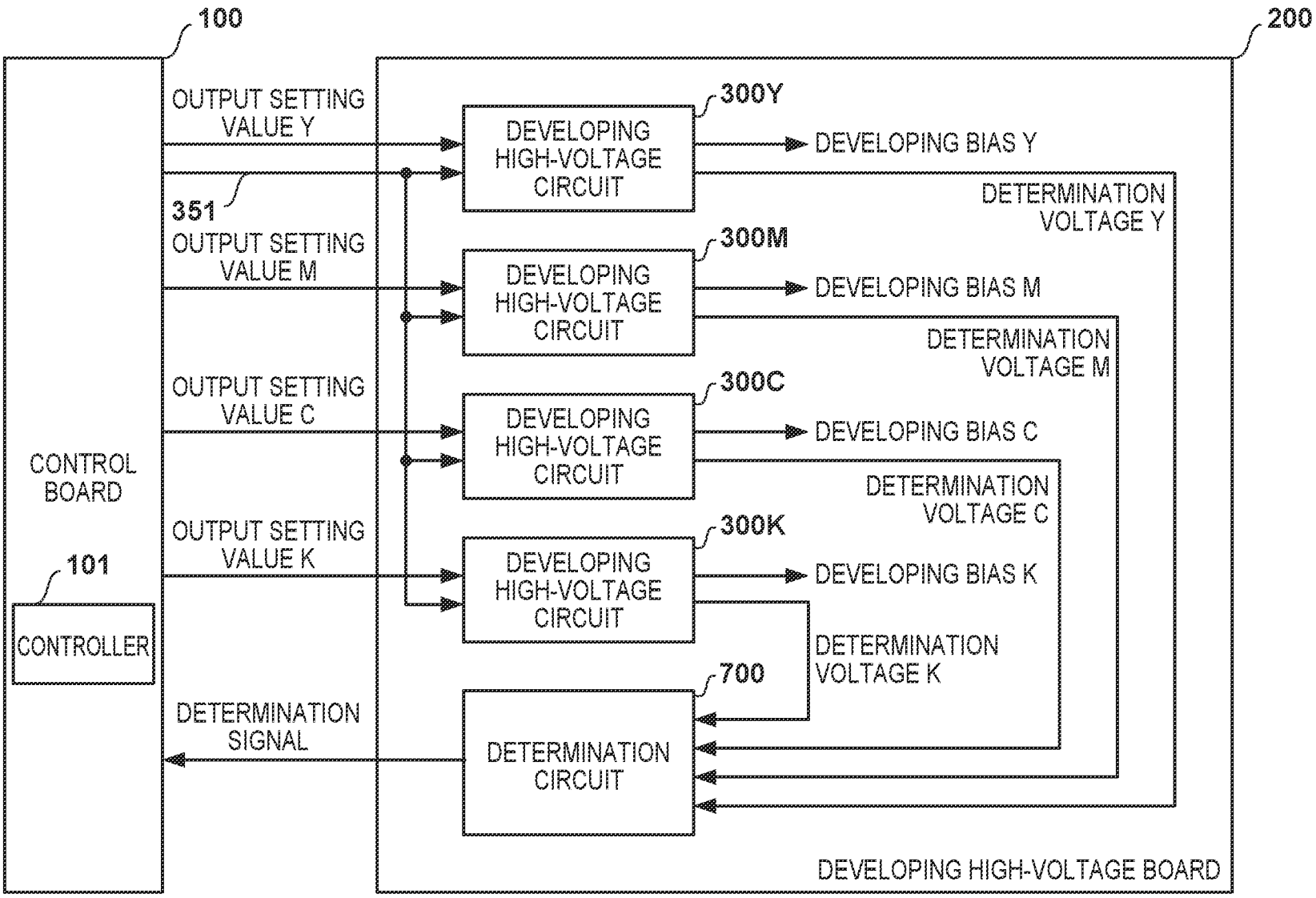
FIG. 2 is a schematic diagram illustrating a developing high-voltage board according to an embodiment.

FIG. 2 illustrates a configuration for generating the developing bias output to the developers 4*a* to 4*d*. A developing high-voltage board 200 includes a plurality of voltage output circuits ("developing high-voltage circuits" hereinafter) 300Y, 300M, 300C, and 300K. The developing high-voltage circuit 300Y generates a developing bias Y of the developer 4*a*, the developing high-voltage circuit 300M generates a developing bias M of the developer 4*b*, the developing high-voltage circuit 300C generates a developing bias C of the developer 4*c*, and the developing high-voltage circuit 300K generates a developing bias K of the developer 4*d*. The developing high-voltage circuits 300Y, 300M, 300C, and 300K each outputs the developing bias on the basis of a drive signal 351 from a controller 101 of a control board 100, and a corresponding output setting value. The developing high-voltage circuits 300Y, 300M, 300C, and 300K each generates a determination voltage on the basis of the output developing bias, and outputs the determination voltage to a determination circuit 700. The determination circuit 700 determines whether or not a malfunction has occurred in the developing high-voltage circuits 300Y, 300M, 300C, and 300K on the basis of the determination voltages, and outputs a binary signal indicating the determination results to the controller 101.

In the present embodiment, the drive signal 351 output by the controller 101 is a clock signal with a frequency of 50 kHz and a duty ratio of 25%, and is input to each of the developing high-voltage circuits 300Y, 300M, 300C, and 300K. The output setting values Y, M, C, and K output by the controller 101 are pulse width modulation (PWM) signals having a voltage of 3.4 V and a frequency of 50 kHz, and are adjusted to a duty ratio based on the developing bias to be output by the corresponding developing high-voltage circuit. As described above, the toner images formed by the image forming units are superimposed on the intermediate transfer belt 5. Accordingly, the timings at which the image forming units begin to form their toner images differ, and with the configuration illustrated in FIG. 1, the yellow image forming unit is the earliest, and the black image forming unit is the latest. In the present embodiment, there is a 600-ms difference between the timings at which the image forming units start forming their images. As such, the controller 101 causes the timings at which the output setting values Y, M, C, and K are output to differ by 600 ms each. In other words, with the drive signal 351 being output, the controller 101 outputs the output setting value Y, and then outputs the output setting value M 600 ms after outputting the output setting value Y. 600 ms after outputting the output setting value M, the controller 101 outputs the output setting value C, and then outputs the output setting value K 600 ms after outputting the output setting value C. When the image formation is complete, the controller 101 stops the output in the order of the output setting values Y, M, C, and K. The interval of this stopping is also 600 ms.

Figure 3:
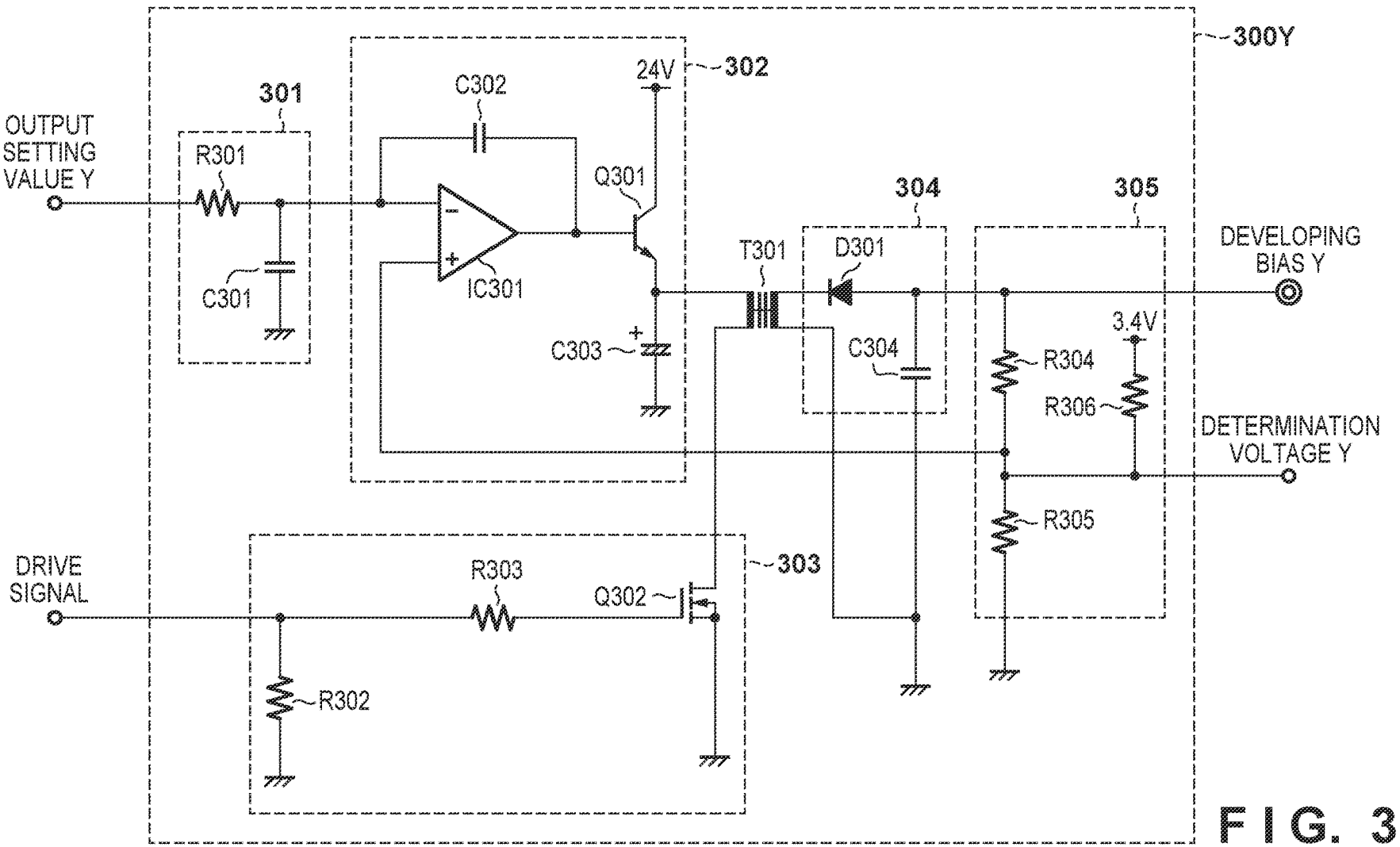
FIG. 3 is a circuit diagram illustrating a developing high-voltage circuit according to an embodiment.

The developing high-voltage circuits 300Y, 300M, 300C, and 300K have the same configurations, and thus the configuration of the developing high-voltage circuit 300Y will be described below as a representative example with reference to FIG. 3. A PWM smoothing unit 301 smoothes the output setting value Y, which is a PWM signal, and transforms the signal into a DC voltage. The PWM smoothing unit 301 is a low-pass filter constituted by a resistor R301 and a capacitor C301. A constant voltage controller 302 is constituted by an op-amp IC301, a capacitor C302, a transistor Q301, and an electrolytic capacitor C303. The DC voltage from the PWM smoothing unit 301 is input to the negative terminal of the op-amp IC301, and a determination voltage Y is input to the positive terminal. The op-amp IC301 constitutes an inverting amplifier circuit that adjusts the output voltage so that the voltages at the negative terminal and the positive terminal match. Note that the capacitor C302 is an integrating element for stabilizing the output voltage of the inverting amplifier circuit. The output of the op-amp IC301 is connected to the base of the transistor Q301, the collector of which is grounded. The emitter of the transistor Q301 is at a voltage that is lower than the output voltage of the op-amp IC301 by an amount equivalent to the base-emitter voltage of the transistor Q301 (approximately 0.6 V). The emitter of the transistor Q301 is connected to the electrolytic capacitor C303, which is for voltage stabilization.

A transformer drive unit 303 is a circuit for driving a transformer T301, and is constituted by a pull-down resistor R302, a damping resistor R303, and a FET Q302. The FET Q302 is repeatedly turned on and off by the drive signal 351. Current flowing in a primary-side coil of the transformer T301 is controlled by the FET Q302 turning on and off. A high-voltage rectifying unit 304 is constituted by a high-voltage diode D301 and a high-voltage ceramic capacitor C304, and rectifies/smoothes the negative voltage of an AC voltage output from the transformer T301, outputting a negative DC voltage as the developing bias Y. A voltage detection unit 305 outputs a voltage, obtained by dividing the developing bias Y and +3.4 V using resistors R304, R305, and R306, as the determination voltage Y.

In the present embodiment, it is assumed that 0 V, −500 V, and −1100 V are output as the developing bias Yin a case where the duty ratio of the output setting value Y is 88%, 50%, and 0%, respectively. Note that the DC voltage output by the PWM smoothing unit 301 is approximately 3.0 V, 1.7 V, and 0 V in a case where the duty ratio of the output setting value Y is 88%, 50%, and 0%, respectively. Additionally, this voltage is output from the circuitry illustrated in FIG. 3 as the determination voltage Y. Accordingly, in the present embodiment, in a case where the developing high-voltage circuit 301Y is functioning normally, 3.0 V, 1.7 V, and 0 V are output as the determination voltage Y when the developing bias Y is 0 V, −500 V, and −1000 V, respectively. Note that the present embodiment also assumes that values less than or equal to −500 V are output as the developing biases Y, M, C, and K. As such, the determination voltages Y, M, C, and K are less than or equal to 1.7 V when the developing high-voltage circuits are functioning normally.

Figure 4:
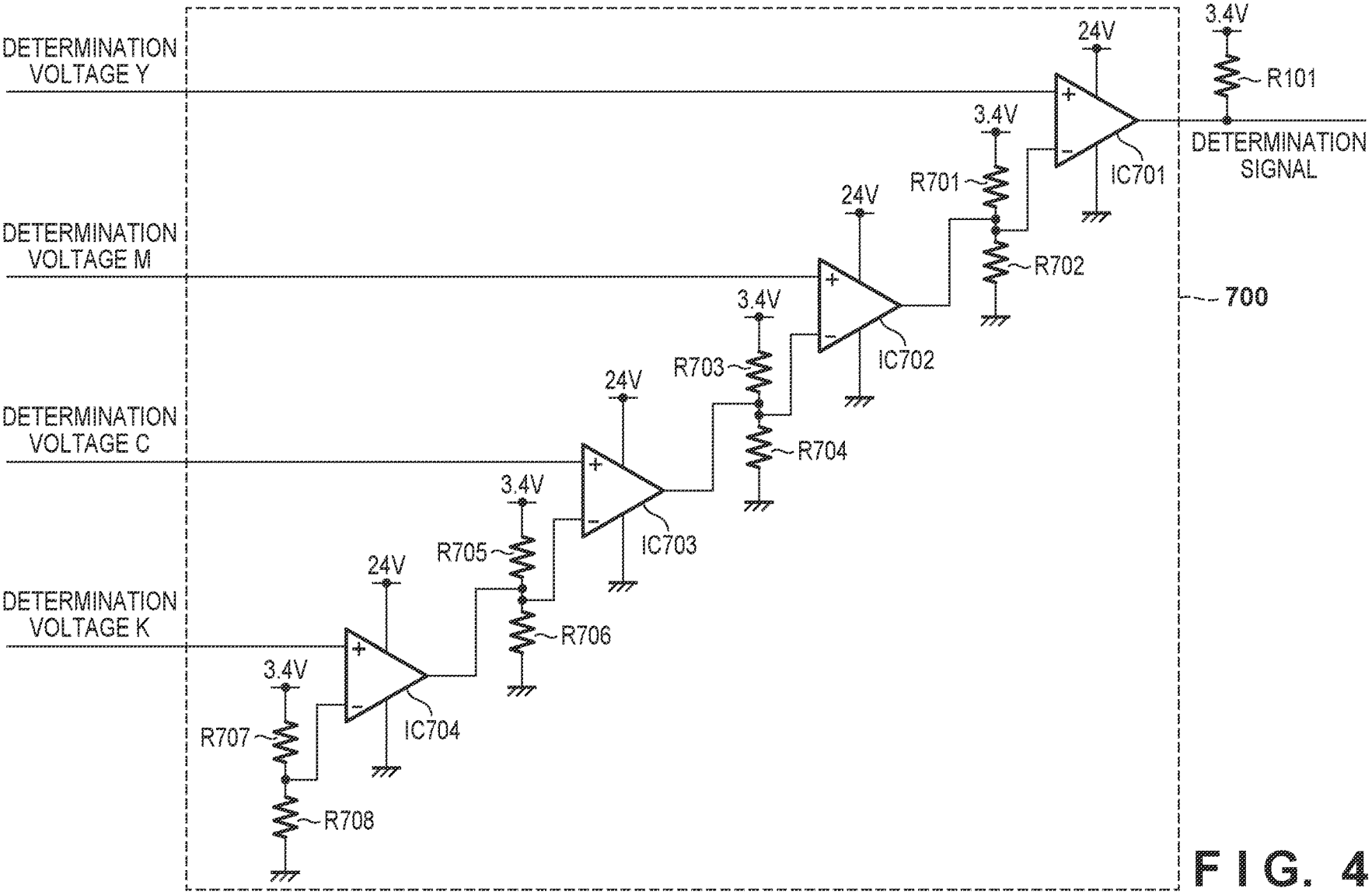
FIG. 4 is a circuit diagram illustrating a determination circuit according to an embodiment.

FIG. 4 is a diagram illustrating the configuration of the determination circuit 700. The determination circuit 700 includes four comparators IC701 to IC704. The determination voltage K is input to the positive terminal of the comparator IC704, and a threshold voltage obtained by dividing 3.4 V using resistors R707 and R708 is input to the negative terminal of the comparator IC704. The present embodiment assumes that the resistances R701, R703, R705, and R707 are at 13 kΩ, and the resistances R702, R704, R706, and R708 are at 27 kΩ. The threshold voltage is therefore 2.3 V. The output of the comparator IC704 is connected to a connection point between the resistor R705 and the resistor R706. The other terminal of the resistor R705 is connected to 3.4 V, and the other terminal of the resistor R706 is grounded (0 V). Furthermore, a connection point between the output of the comparator IC704, the resistor R705, and the resistor R706 is input to the negative terminal of the comparator IC703. The determination voltage C is input to the positive terminal of the comparator IC703. The connection relationship between the comparator IC702 and the comparator IC703 is the same as the connection relationship between the comparator IC703 and the comparator IC704. However, the determination voltage M is input to the positive terminal of the comparator IC702. Furthermore, the connection relationship between the comparator IC701 and the comparator IC702 is the same as the connection relationship between the comparator IC702 and the comparator IC703. However, the determination voltage Y is input to the positive terminal of the comparator IC701. The output of the comparator IC701 is output to the controller 101 as a determination signal. The determination signal is pulled up to 3.4 V through the resistor R301 within the control board 100.

The relationship between the output states of the developing biases at the start of image formation and the value of the determination signal will be described next with reference to FIG. 5. Note that in FIG. 5, "H" indicates that the voltage at the positive terminal of the comparator IC is greater than or equal to the voltage at the negative terminal, so that the output of the comparator IC is in an open state. On the other hand, "L" in FIG. 5 indicates that the voltage at the positive terminal of the comparator IC is lower than the voltage at the negative terminal, so that the output of the comparator IC is at 0 V. As illustrated in FIG. 4, the output of the comparator IC701 is pulled up to 3.4 V through a resistor R101 within the control board 100. Accordingly, when the output of the comparator IC701 is open (H), the determination signal goes to high level (H), and when the output of the comparator IC701 is 0 V (L), the determination signal goes to low level (L).

When Output of all Developing Biases Stops: #1 in FIG. 5

When the output of all the developing biases Y, M, C, and K is stopped, as described above, the determination voltages Y, M, C, and K are at 3.0 V, which is higher than the threshold voltage of 2.3 V. Accordingly, the output of the comparator IC704 is open, and the voltage input to the negative terminal of the comparator IC703 is the threshold voltage of 2.3 V. The output of the comparator IC703 is therefore also open. The same applies to the comparator IC702 and the comparator IC701, and thus the output of the comparator IC701 is also open. The determination signal therefore goes to high level (H).

When Developing Bias Y is Output: #2 in FIG. 5

As described above, when forming an image, the image forming apparatus 10 first outputs the developing bias Y. The output of the other developing biases is stopped, and thus the outputs of the comparators IC702 to 704 are the same as in #1 of FIG. 5. As described above, if the developing high-voltage circuit 301Y is functioning normally, the value of the determination voltage Y is less than or equal to 1.7 V, and thus the voltage at the positive terminal of the comparator IC701 is lower than the threshold voltage of 2.3 V. Accordingly, the output of the comparator IC701 is 0 V, and the determination signal goes to low level (L).

When Developing Bias M is Output: #3 in FIG. 5

As described above, once 600 ms has passed after the developing bias Y was output, the image forming apparatus 10 outputs the developing bias M. The developing biases C and K are not being output, and thus the outputs of the comparators IC703 and 704 are the same as in #2 of FIG. 5. As described above, if the developing high-voltage circuits 301Y and 301M are functioning normally, the value of the determination voltage M is less than or equal to 1.7 V, and thus the voltage at the positive terminal of the comparator IC702 is lower than the threshold voltage of 2.3 V. The output of the comparator IC702 is therefore 0 V. Accordingly, the voltage at the negative terminal of the comparator IC701 goes to 0 V, and the voltage at the positive terminal (where the determination voltage Y is input) is higher, and thus the output of the comparator IC701 is open. The determination signal therefore goes to high level (H).

When Developing Bias C is Output: #4 in FIG. 5

As described above, once 600 ms has passed after the developing bias M was output, the image forming apparatus 10 outputs the developing bias C. Like when the developing bias M is output, the output of the comparator IC703 goes to 0 V in response to the output of the developing bias C, and the output of the comparator IC702 is therefore open. Accordingly, the output of the comparator IC701 is 0 V, and the determination signal goes to low level (L).

When Developing Bias K is Output: #5 in FIG. 5

As described above, once 600 ms has passed after the developing bias C was output, the image forming apparatus 10 outputs the developing bias K. Like when the developing bias C is output, the output of the comparator IC704 goes to 0 V in response to the output of the developing bias K. The output of the comparator IC703 is therefore open, and the output of the comparator IC702 goes to 0 V. The output of the comparator IC701 is therefore open, and the determination signal goes to high level (H).

In this manner, when image formation is started, and the developing biases Y, M, C, and K are output normally in that order from a state where the output of all the developing biases is stopped, the determination signal is output with a pattern in which high level and low level alternate in order. Accordingly, the controller 101 can detect whether or not the developing high-voltage board 200 is operating normally by monitoring the level of the determination signal, which inverts each time a developing bias is output, when the determination signal is at high level in a state where the output of all the developing biases is stopped.

Figure 6:
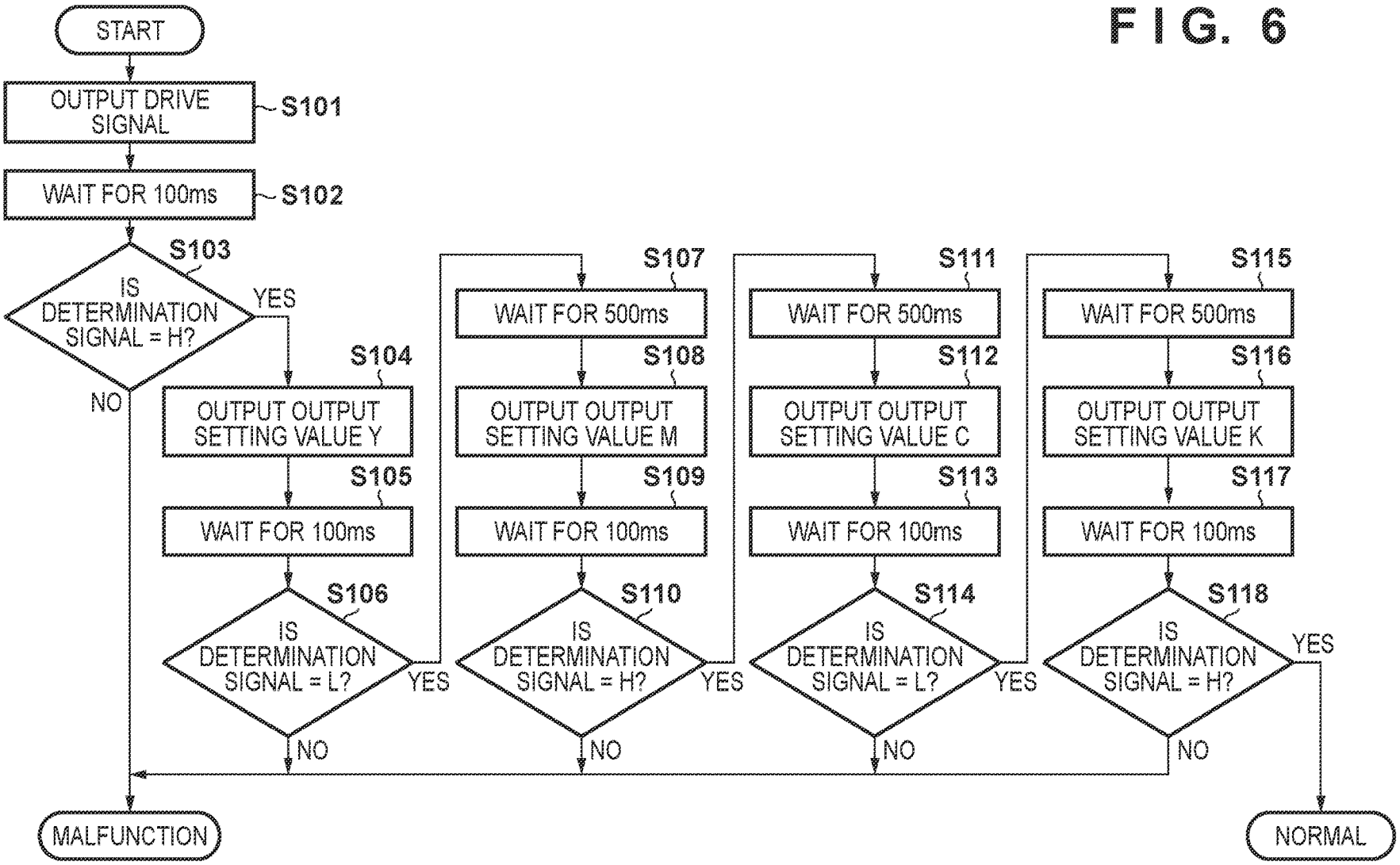
FIG. 6 is a flowchart illustrating the malfunction detection process according to an embodiment.

FIG. 6 is a flowchart illustrating a malfunction detection process carried out by the developing high-voltage board 200 at the start of image formation. In step S101, the controller 101 outputs the drive signal 351. In step S102, the controller 101 waits for 100 ms, and then, in step S103, determines whether or not the determination signal is high level. When the determination signal is low level, the controller 101 determines that the developing high-voltage board 200 has malfunctioned. On the other hand, when the determination signal is high level, in step S104, the controller 101 outputs the output setting value Y, and causes the developing high-voltage circuit 300Y to output the developing bias Y and the determination voltage Y. In step S105, the controller 101 waits for 100 ms, and then, in step S106, determines whether or not the determination signal is low level. When the determination signal is high level, the controller 101 determines that the developing high-voltage board 200 has malfunctioned. On the other hand, when the determination signal is low level, in step S107, the controller 101 waits for 500 ms, and in step S108, outputs the output setting value M, and causes the developing high-voltage circuit 300M to output the developing bias M and the determination voltage M. In step S109, the controller 101 waits for 100 ms, and then, in step S110, determines whether or not the determination signal is high level. When the determination signal is low level, the controller 101 determines that the developing high-voltage board 200 has malfunctioned.

On the other hand, when the determination signal is high level, in step S111, the controller 101 waits for 500 ms, and in step S112, outputs the output setting value C, and causes the developing high-voltage circuit 300C to output the developing bias C and the determination voltage C. In step S113, the controller 101 waits for 100 ms, and then, in step S114, determines whether or not the determination signal is low level. When the determination signal is high level, the controller 101 determines that the developing high-voltage board 200 has malfunctioned. On the other hand, when the determination signal is low level, in step S115, the controller 101 waits for 500 ms, and in step S116, outputs the output setting value K, and causes the developing high-voltage circuit 300K to output the developing bias K and the determination voltage K. In step S117, the controller 101 waits for 100 ms, and then, in step S118, determines whether or not the determination signal is high level. When the determination signal is low level, the controller 101 determines that the developing high-voltage board 200 has malfunctioned. On the other hand, when the determination signal is high level, the controller 101 determines that the developing high-voltage board 200 is operating normally.

The controller 101 waits for 100 ms in steps S102, S105, S109, S113, and S117 to take into account the time required for the outputs from the developing high-voltage board 200 to stabilize. Additionally, the controller 101 waits for 500 ms in steps S107, S111, and S115 because in the present embodiment, a given developing bias is output 600 ms after the previous developing bias was output.

As described thus far, according to the present embodiment, when normal developing biases are output in order when forming an image, the output pattern of the determination signal is a pattern in which the value of the signal inverts each time a developing bias is output. According to this configuration, malfunctions can be determined for a plurality of developing high-voltage circuits using a binary determination signal output from a single signal line. The determination signal is at high level when all of the developing biases are being output normally. As such, a configuration can be realized in which the controller 101 monitors the determination signal even while all of the developing biases are being output, and determines that the developing high-voltage board 200 has malfunctioned when the determination signal goes to low level. In the above-described embodiment, the threshold voltages input to the comparators IC701 to 704 are all 2.3 V. However, the threshold voltage is determined on the basis of the range of the determination voltage when the developing bias is being output normally, and the configuration can be such that the value of the threshold voltage is different for each comparator IC. Additionally, according to the present embodiment, when normal developing biases are output in order, the output pattern of the determination signal is a pattern in which the value of the signal inverts each time a developing bias is output. However, the configuration may be such that the pattern of the determination signal in a case where normal developing biases have been output in order is another predetermined pattern. In either case, the controller 101 monitors how the determination signal changes in accordance with the predetermined pattern while controlling the developing high-voltage circuits to output the developing biases in order, and determines that the developing high-voltage board 200 has malfunctioned when a change that is different from the predetermined pattern occurs.

The determination circuit 700 in FIG. 4 determines whether the four voltage output circuits have malfunctioned. However, the following will describe a more general case where it is determined whether or not n (where n is an integer greater than or equal to 2) voltage output circuits have malfunctioned. First, the n voltage output circuits will be called a first voltage output circuit to an n-th voltage output circuit. Note that at the start of image formation, the controller 101 controls the first voltage output circuit to the n-th voltage output circuit so that the biases are output at predetermined intervals in ascending order starting from the first voltage output circuit. A k-th voltage output circuit (where k is an integer from 1 to n) is assumed to output a k-th bias voltage and a k-th determination voltage. In this case, the determination circuit 700 includes a first determination unit to an n-th determination unit. The first determination unit to the n-th determination unit are comparator ICs, for example. The n-th determination unit compares an n-th threshold with an n-th determination voltage, determines whether or not an n-th bias voltage is being output normally, and outputs an n-th comparison result indicating a first result if the n-th bias voltage is being output normally. However, when such is not the case, the n-th determination unit outputs an n-th comparison result indicating a second result. "When such is not the case" also includes situations where the controller 101 is not outputting the n-th bias voltage (i.e., is outputting 0 V). Note that the first result corresponds to low level (0 V) in the configuration illustrated in FIG. 4. On the other hand, the second result corresponds to high level (open) in the configuration illustrated in FIG. 4.

An m-th determination unit (where m is an integer from 1 to (n−1)) compares an m-th threshold with an m-th determination voltage when an (m+1)-th comparison result from an (m+1)-th determination unit indicates the second result (H), and determines whether or not an m-th bias voltage is being output normally from an m-th voltage output circuit. The m-th determination unit then outputs an m-th comparison result indicating the first result or the second result in accordance with the determination result. On the other hand, if the (m+1)-th comparison result indicates the first result, the m-th determination unit outputs the m-th comparison result indicating the second result (H). The determination signal is generated on the basis of the first comparison result. Note that the k-th threshold is set to a value between the k-th determination voltage when the k-th bias voltage is being output normally, and the k-th determination voltage when the k-th bias voltage is not being output.

Second Embodiment

In the first embodiment, it is determined whether or not the developing high-voltage board 200 has malfunctioned while the developing biases are being output in order from the start of image formation. However, when the image formation ends, the output of the developing biases Y, M, C, and K stops in that order, and thus with the configuration of the first embodiment, a malfunction in the developing high-voltage board 200 cannot be determined when the image formation ends. Specifically, when all the developing biases are being output, the input to the negative terminal of the comparator IC701 is 0 V, as indicated by #5 in FIG. 5. On the other hand, when the developing bias Y is being output normally, the determination voltage Y input to the positive terminal of the comparator IC701 is less than or equal to 1.7 V. In other words, the voltage input to the positive terminal of the comparator IC701 is greater than the voltage input to the negative terminal. If the output of the developing bias Y is stopped in this state, the determination voltage Y input to the positive terminal of the comparator IC701 goes to 3.0 V, but the magnitude relationship between the voltages at the positive terminal and the negative terminal of the comparator IC701 does not change. The determination signal remains at high level, as indicated by #6 in FIG. 5. The input to the negative terminal of the comparator IC701 is 2.3 V, which is the threshold voltage, or 0 V, both of which are lower than the 3.0 V input to the positive terminal of the comparator IC701. As such, even if the developing biases stop in order thereafter, as indicated by #7, 8, and 9 in FIG. 5, the output of the comparator IC701 remains open, and the determination signal therefore remains at high level. This means that with the configuration described in the first embodiment, the controller 101 cannot determine whether or not the developing high-voltage board 200 has malfunctioned when the image formation ends. In the present embodiment, however, a malfunction in the developing high-voltage board 200 is determined not only at the start of the image formation, but also while the output of the developing biases is stopped in order at the end of the image formation.

Figure 7:
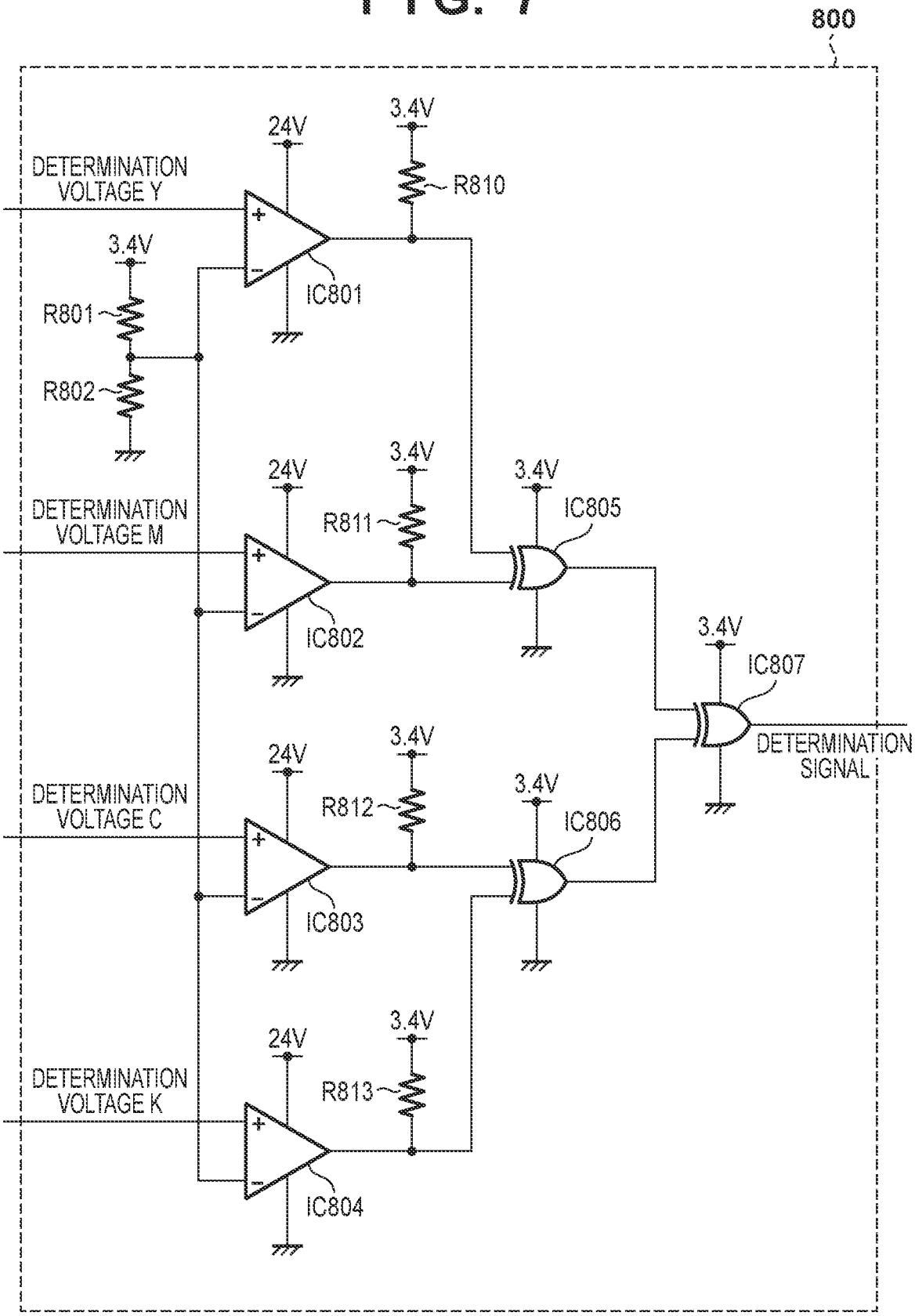
FIG. 7 is a circuit diagram illustrating a determination circuit according to an embodiment.

The configuration of the developing high-voltage board 200 according to the present embodiment replaces the determination circuit 700 illustrated in FIG. 2 (FIG. 4) with a determination circuit 800, illustrated in FIG. 7. The determination circuit 800 includes comparators IC801, IC802, IC803, and IC804. The determination voltages Y, M, C, and K are input to the positive terminals of the comparators IC801, IC802, IC803, and IC804, respectively. The resistance values of resistors R801 and R802 are 13 kΩ and 27 kΩ, respectively, and 2.3 V, which is the threshold voltage, is input to the negative terminals of the comparators IC801, IC802, IC803, and IC804.

The outputs of the comparators IC801 and 802 are input to an exclusive OR (EXOR) IC (exclusive OR circuit) 805. The outputs of the comparators IC803 and 804 are input to an EXOR IC806. Note that the outputs of the comparators IC801, IC802, IC803, and IC804 are pulled up to 3.4 V through resistors R810, R811, R812, and R813, respectively. The outputs of the EXORs IC805 and 806 are input to an EXOR IC807, and the output of the EXOR IC807 serves as the determination signal.

While the output of the developing bias is stopped, the determination voltages are 3.0 V, which is higher than the threshold voltage. Accordingly, the output of the corresponding comparator IC is open, and high level (H) is input to the corresponding EXOR IC. However, when the developing bias is output normally, the determination voltages are lower than the threshold voltage. Accordingly, the output of the corresponding comparator IC goes to 0 V, and low level (L) is input to the corresponding EXOR IC. The relationship between the output states of the developing biases and the value of the determination signal, when the developing biases are output in order at the start of image formation and the output of the developing biases is stopped in order at the end of image formation, will be described next with reference to FIG. 8.

When Output of all Developing Biases Stops: #1 in FIG. 8

When the output of all of the developing biases Y, M, C, and K is stopped, the comparators IC801 to 804 output high level, as described above. Accordingly, the outputs of the EXORs IC805 and 806 both go to low level. The determination signal, which is the output of the EXOR IC807, goes to low level as a result.

When Developing Bias Y is Output: #2 in FIG. 8

When the developing bias Y is output, the comparator IC801 goes to low level, and the output of the EXOR IC805 goes to high level as a result. The output of the EXOR IC806 remains at low level. The determination signal, which is the output of the EXOR IC807, goes to high level as a result.

When Developing Bias M is Output: #3 in FIG. 8

When the developing bias M is output, the comparator IC802 goes to low level, and the output of the EXOR IC805 goes to low level as a result. The output of the EXOR IC806 remains at low level. The determination signal, which is the output of the EXOR IC807, goes to low level as a result.

When Developing Bias C is Output: #4 in FIG. 8

When the developing bias C is output, the comparator IC803 goes to low level, and the output of the EXOR IC806 goes to high level as a result. The output of the EXOR IC805 remains at low level. The determination signal, which is the output of the EXOR IC807, goes to high level as a result.

When Developing Bias K is Output: #5 in FIG. 8

When the developing bias K is output, the comparator IC804 goes to low level, and the output of the EXOR IC806 goes to low level as a result. The output of the EXOR IC805 remains at low level. The determination signal, which is the output of the EXOR IC807, goes to low level as a result.

When Output of Developing Bias Y Stops: #6 in FIG. 8

When the output of the developing bias Y stops, the comparator IC801 goes to high level, and the output of the EXOR IC805 goes to high level as a result. The output of the EXOR IC806 remains at low level. The determination signal, which is the output of the EXOR IC807, goes to high level as a result.

When Output of Developing Bias M Stops: #7 in FIG. 8

When the output of the developing bias M stops, the comparator IC802 goes to high level, and the output of the EXOR IC805 goes to low level as a result. The output of the EXOR IC806 remains at low level. The determination signal, which is the output of the EXOR IC807, goes to low level as a result.

When Output of Developing Bias C Stops: #8 in FIG. 8

When the output of the developing bias C stops, the comparator IC803 goes to high level, and the output of the EXOR IC806 goes to high level as a result. The output of the EXOR IC805 remains at low level. The determination signal, which is the output of the EXOR IC807, goes to high level as a result.

When Output of Developing Bias K Stops: #9 in FIG. 8

When the output of the developing bias K stops, the comparator IC804 goes to high level, and the output of the EXOR IC806 goes to low level as a result. The output of the EXOR IC805 remains at low level. The determination signal, which is the output of the EXOR IC807, goes to low level as a result.

As illustrated in FIG. 8, when the developing biases are output in order from a state in which the output of all the developing biases is stopped, if the developing high-voltage board 200 is operating normally, the value of the determination signal inverts each time the developing bias is output, in the same manner as in the first embodiment. Furthermore, in the present embodiment, when the output of the developing biases is stopped in order from a state in which all of the developing biases are being output, if the developing high-voltage board 200 is operating normally, the value of the determination signal inverts each time the output of a developing bias stops. Thus according to the present embodiment, a malfunction can be determined in the developing high-voltage board 200 not only at the start of image formation, but also at the end of image formation.

A flowchart for the malfunction detection process carried out by the developing high-voltage board 200 at the start of image formation in the present embodiment is the same as that in the first embodiment, aside from the logic (H and L) being opposite from that in steps S103, S106, S110, S114, and S118 of FIG. 6. The malfunction detection process by the developing high-voltage board 200 at the end of image formation can be thought of in the same way as the process for the start of image formation. In other words, the controller 101 determines whether the logic of the determination signal has inverted each time the output of the developing biases stops, in the order of the developing biases Y, M, C, and K. If the logic of the determination signal does not invert, the controller 101 determines that the developing high-voltage board 200 has malfunctioned. On the other hand, if the logic of the determination signal inverts when the output of the developing biases Y, M, C, and K stops, the controller 101 determines that the developing high-voltage board 200 is operating normally. While all the developing biases Y, M, C, and K are being output, the controller 101 monitors whether the determination signal is at low level, and the controller 101 can determine that the developing high-voltage board 200 has malfunctioned if the determination signal goes to high level.

The determination circuit 800 in FIG. 7 determines whether the four voltage output circuits have malfunctioned. However, the following will describe a more general case where it is determined whether or not n (where n is an integer greater than or equal to 2) voltage output circuits have malfunctioned. First, the n voltage output circuits will be called a first voltage output circuit to an n-th voltage output circuit. Note that at the start of image formation, the controller 101 controls the first voltage output circuit to the n-th voltage output circuit so that the biases are output in ascending order starting from the first voltage output circuit. At the end of image formation, the controller 101 controls the first voltage output circuit to the n-th voltage output circuit so that the output of the biases is stopped in ascending order starting from the first voltage output circuit. A k-th voltage output circuit (where k is an integer from 1 to n) is assumed to output a k-th bias voltage and a k-th determination voltage. The determination circuit includes a first determination unit to an n-th determination unit. The first determination unit to the n-th determination unit are comparators IC, for example. The k-th determination unit compares the k-th threshold with the k-th determination voltage, and determines whether the k-th bias voltage is being output normally from the k-th voltage output circuit. If the k-th bias voltage is being output normally, a k-th comparison result, indicating a first result, is output. However, when such is not the case, the k-th determination unit outputs a k-th comparison result indicating a second result. "When such is not the case" also includes situations where the controller 101 is not outputting the k-th bias voltage. Note that the first result corresponds to low level (0 V) in the configuration illustrated in FIG. 7. On the other hand, the second result corresponds to high level (open) in the configuration illustrated in FIG. 7. The determination circuit 800 also includes a logic unit into which the first comparison result to the n-th comparison result are input. The logic unit is constituted by logic circuits such as AND, OR, EXOR, and the like. The logic unit performs a logical operation on the first comparison result to the n-th comparison result and generates a determination signal having a predetermined pattern in a case where the normal biases are being output in order. The logic unit also carries out a logical operation on the first comparison result to the n-th comparison result, and generates a determination signal having a predetermined pattern in a case where the output of the biases has stopped in the normal order.

The embodiments have described a developing high-voltage circuit that outputs a developing bias voltage as an example. However, the present disclosure can be applied in the same manner in the monitoring of malfunctions in a plurality of voltage output circuits that output the charging bias voltages, primary transfer bias voltages, and the like of the image forming units. Furthermore, although the absolute value of the determination voltage decreases as the absolute value of the bias increases in the above embodiments, the configuration may be such that the absolute value of the determination voltage increases as the absolute value of the bias increases. Furthermore, the specific circuit configurations of the determination circuits according to the embodiments are merely examples, and other circuit configurations that output a determination signal having a predetermined pattern by outputting and stopping the biases in order, such as those illustrated in FIGS. 5 and 8, can be used as well.

Further still, the present disclosure can also be realized in any desired apparatus, as a bias output apparatus that outputs a plurality of voltages (biases) to be supplied to load by the apparatus.

OTHER EMBODIMENTS

Embodiments of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-135223, filed on Jul. 18, 2018, which is hereby incorporated by reference herein in its entirety.

What is claimed is:

1. A bias output apparatus comprising:

a plurality of voltage output circuits, each configured to output a bias voltage to be supplied to a load and a determination voltage generated based on the bias voltage;

a determination circuit configured to output a binary determination signal based on the determination voltage output by each of the plurality of voltage output circuits; and a controller configured to control the plurality of voltage output circuits and determine whether or not the plurality of voltage output circuits are operating normally based on the determination signal output by the determination circuit, wherein the controller is further configured to determine that the plurality of voltage output circuits are operating normally if an output pattern of the determination signal is a predetermined first pattern while the controller is controlling the plurality of voltage output circuits to output bias voltages in order.

2. The bias output apparatus according to claim 1, wherein the predetermined first pattern is a pattern in which a level of the determination signal inverts each time one of the plurality of voltage output circuits outputs the bias voltage.

3. The bias output apparatus according to claim 1, wherein the plurality of voltage output circuits include a first voltage output circuit to an n-th voltage output circuit, where n is an integer greater than or equal to 2;

a k-th voltage output circuit, where k is an integer from 1 to n, is configured to output a k-th bias voltage and a k-th determination voltage generated from the k-th bias voltage;

the determination circuit includes a first determination circuit to an n-th determination circuit respectively corresponding to the first voltage output circuit to the n-th voltage output circuit;

the n-th determination circuit is configured to compare an n-th threshold with an n-th determination voltage and output an n-th comparison result indicating a first result or a second result;

an m-th determination circuit, where m is an integer from 1 to n−1, is configured to compare an m-th threshold with an m-th determination voltage, and output an m-th comparison result indicating the first result or the second result, when a (m+1)-th comparison result from an (m+1)-th determination circuit indicates the second result, and is configured to output the m-th comparison result indicating the second result when the (m+1)-th comparison result from an (m+1)-th determination circuit indicates the first result;

the determination circuit is configured to output the determination signal based on the a first comparison result from the first determination circuit; and the controller controls the plurality of voltage output circuits so that a (m+1)-th voltage output circuit outputs a (m+1)-th bias voltage after an m-th voltage output circuit has output an m-th bias voltage.

4. The bias output apparatus according to claim 3, wherein the n-th determination circuit is configured to determine whether an n-th bias voltage is being output normally by comparing the n-th threshold with the n-th determination voltage, output the n-th comparison result indicating the first result in a case where the n-th bias voltage is being output normally, and output the n-th comparison result indicating the second result when such is not the case; and the m-th determination circuit is configured to determine whether the m-th bias voltage is being output normally by comparing the m-th threshold with the m-th determination voltage when the (m+1)-th comparison result indicates the second result, output the m-th comparison result indicating the first result in a case where the m-th bias voltage is being output normally, and output the m-th comparison result indicating the second result when such is not the case.

5. The bias output apparatus according to claim 3, wherein a k-th threshold is a value between the k-th determination voltage when the k-th bias voltage is being output normally and the k-th determination voltage when the k-th bias voltage is not being output.

6. The bias output apparatus according to claim 3, wherein each of the first determination circuit to the n-th determination circuit includes a comparator.

7. The bias output apparatus according to claim 1, wherein the plurality of voltage output circuits include a first voltage output circuit to an n-th voltage output circuit, where n is an integer greater than or equal to 2;

a k-th voltage output circuit, where k is an integer from 1 to n, is configured to output a k-th bias voltage and a k-th determination voltage generated from the k-th bias voltage;

the determination circuit includes a first determination circuit to an n-th determination circuit respectively corresponding to the first voltage output circuit to the n-th voltage output circuit;

a k-th determination circuit is configured to compare a k-th threshold with the k-th determination voltage and output a k-th comparison result indicating a first result or a second result; and the determination circuit includes a logic circuit configured to generate the determination signal by performing a logical operation on results indicated by a first comparison result to a n-th comparison result.

8. The bias output apparatus according to claim 7, wherein n=4;

the logic circuit includes:

a first exclusive OR circuit into which the first comparison result and a second comparison result are input;

a second exclusive OR circuit into which a third comparison result and a fourth comparison result are input; and a third exclusive OR circuit into which outputs of the first exclusive OR circuit and the second exclusive OR circuit are input, and an output of the third exclusive OR circuit is output as the determination signal.

9. The bias output apparatus according to claim 1, wherein the controller is further configured to determine whether or not the plurality of voltage output circuits are operating normally by monitoring the determination signal while the controller is controlling the plurality of voltage output circuits so that all the plurality of voltage output circuits output the bias voltages.

10. The bias output apparatus according to claim 1, wherein the controller is further configured to determine that the plurality of voltage output circuits are operating normally if the output pattern of the determination signal is a predetermined second pattern while the controller is controlling the plurality of voltage output circuits to stop the output of the bias voltages in order.

11. The bias output apparatus according to claim 10, wherein the predetermined second pattern is a pattern in which the output of the determination signal inverts each time one of the plurality of voltage output circuits stops the output of the bias voltage.

12. An image forming apparatus comprising:

an image forming unit configured to form an image on a sheet; and a bias output circuit configured to generate and output a bias voltage used when the image forming unit forms the image on the sheet, wherein the bias output circuit includes:

a plurality of voltage output circuits, each configured to output the bias voltage and a determination voltage generated based on the bias voltage;

a determination circuit configured to output a binary determination signal on the basis of the determination voltages output by each of the plurality of voltage output circuits; and a controller configured to control the plurality of voltage output circuits and determine whether or not the plurality of voltage output circuits are operating normally based on the determination signal output by the determination circuit, wherein the controller is further configured to determine that the plurality of voltage output circuits are operating normally if an output pattern of the determination signal is a predetermined first pattern while the controller is controlling the plurality of voltage output circuits to output the bias voltages in order.

13. The image forming apparatus according to claim 12, wherein the bias output circuit outputs a charging bias voltage, a developing bias voltage, or a transfer bias voltage used by the image forming unit.

* * * * *